United States Patent [19]

Twigger

[11] 4,453,311

[45] Jun. 12, 1984

[54] SCISSORS WITH THUMB RETAINER

[76] Inventor: Alan R. Twigger, 1825 SE. 46th Ave., Portland, Oreg. 97215

[21] Appl. No.: 436,014

[22] Filed: Oct. 22, 1982

[51] Int. Cl.[3] ..... B26B 13/20

[52] U.S. Cl. ..... 30/254; 30/341

[58] Field of Search ..... 30/254, 232, 341, 257, 30/259, 260

[56] References Cited

U.S. PATENT DOCUMENTS

| | | | |
|---|---|---|---|
| D. 20,422 | 12/1890 | Pearsall | 30/341 X |
| 85,500 | 12/1868 | Witte | 30/341 |
| D. 219,420 | 12/1970 | Cline . | |
| 242,000 | 5/1881 | Klaucke | 30/341 |
| 430,677 | 6/1890 | Pearsall | 30/341 |
| 440,436 | 11/1890 | Pearsall | 30/341 |
| 590,330 | 9/1897 | Nolen | 30/254 |
| 1,108,572 | 8/1914 | Gordon | 30/232 |
| 1,891,688 | 12/1932 | Parker | 30/232 |
| 4,024,634 | 5/1977 | Linden | 30/341 |
| 4,140,124 | 2/1979 | Curutchet | 30/232 |

*Primary Examiner*—Jimmy C. Peters

*Attorney, Agent, or Firm*—Kolisch, Hartwell, Dickinson & Anderson

[57] ABSTRACT

Scissors with thumb retainer for receiving the two phalanges of the thumb. The thumb retainer integrally joins and is generally in line with the shank of the thumb-actuated blade. It includes a cup portion against which the outer end of the distal phalanx seats and an elongate sleeve portion joined to the cup portion, constructed to restrain the two thumb phalanges therein. During a cutting operation, upward and downward movement of the thumb occurs in the swing plane of the blades and is generally parallel to the palm of the hand.

5 Claims, 4 Drawing Figures

SCISSORS WITH THUMB RETAINER

BACKGROUND AND SUMMARY OF THE INVENTION

This invention relates to scissors and, more particularly, to scissors having a thumb retainer for receiving the two phalanges of the thumb and restraining the phalanges from substantial articulation therein, with the axis of the thumb retainer lying substantially in the swing plane of the blades.

Conventional scissors typically include a thumb-actuated blade and a finger-actuated blade pivotally connected for movement in a swing plane. Joined to the shank of the thumb-actuated blade is a handle which includes an arcuate loop for receiving the thumb. Joined to the shank of the finger-actuated blade is a larger, elongate loop for receiving two fingers therein. The longitudinal axes of the handles lies substantially within the swing plane of the blades. When the thumb of an operator is inserted in the arcuate loop of the thumb handle, the thumb extends at an acute angle from the longitudinal axes of the handles and the swing plane of the blades. With movement of the handles to produce actuation of the scissors, the thumb as it moves toward the fingers twists or turns outwardly. Further, the thumb itself articulates. Prolonged usage of such scissors results in extreme fatigue in, and eventually may cause tearing of, the tendons which extend from the thumb to the elbow.

A general object of the present invention is to provide scissors having a thumb retainer which decreases fatigue in the tendons which extend from the thumb to the elbow.

Another object is to provide scissors having a thumb retainer which receives the two phalanges of the thumb and restrains them from substantial articulation therein.

A further object is to provide scissors having a thumb retainer where the axis of the retainer lies substantially within the swing plane of the blades.

Yet another object is to provide, in scissors of the above description, lightweight handles for receiving the thumb and the fingers, such as handles constructed of molded plastic.

A preferred embodiment of the proposed invention includes scissors having a thumb retainer for receiving the two phalanges of the thumb, integrally joined to the shank of the thumb-actuated blade. The thumb retainer includes a cup portion which provides an abutment against which the outer end of the distal phalanx seats, and an elongate sleeve portion joined with the cup portion, which receives the two thumb phalanges and restrains them from substantial articulation therein. The longitudinal axis of the thumb retainer lies substantially within the swing plane of the blades.

These and other objects and advantages are obtained by the invention which will become more fully apparent from a reading of the following description, which is to be taken in conjunction with the accompanying drawings wherein.

DETAILED DESCRIPTION OF A PREFERRED EMBODIMENT OF THE INVENTION

Figure 1:
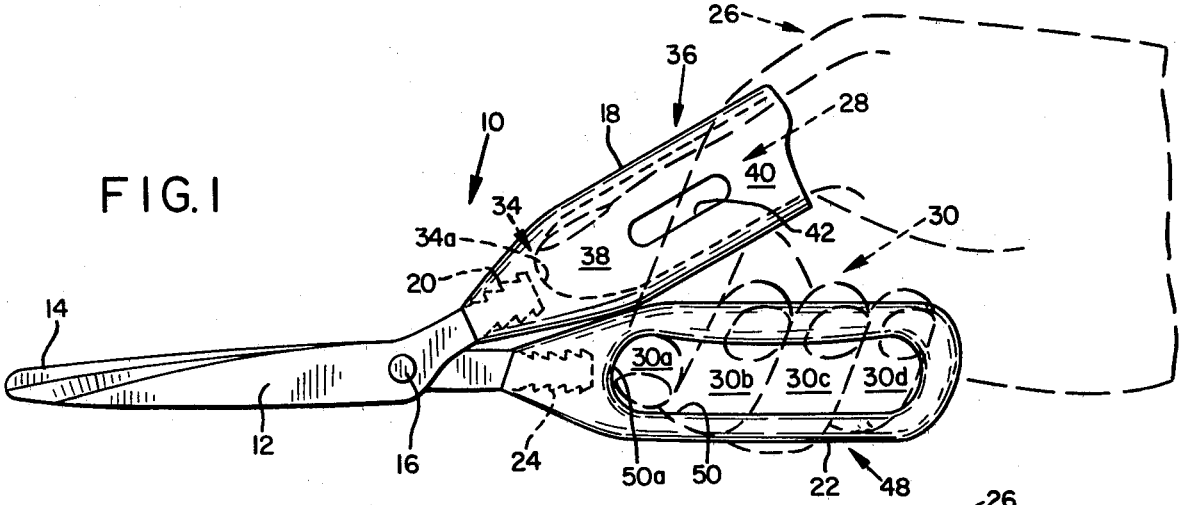
FIG. 1 is a side elevation of a pair of scissors constructed in accordance with a preferred embodiment of the invention, showing the scissors in a closed position and showing a hand inserted therein in phantom lines.

Referring now to the drawings, and more particularly to FIG. 1, there is shown generally at 10 a pair of scissors having a conventional thumb-actuated blade 12 and a finger-actuated blade 14 which are pivotally interconnected by a pivot means 16.

Each blade, 12, 14, has an associated shank 20, 24, respectively, integrally joined thereto. The blade and its associated shank extend outwardly to opposite sides of pivot means 16. Shank 24 is aligned with its blade 14, whereas shank 20 extends outwardly at an obtuse angle from blade 12.

Blades 12, 14 are of a conventional, metallic construction. Pivot means 16 interconnects the two blades, enabling them to swing relative to each other in a plane which is perpendicular to the axis of pivot means 16, shown by line 32 in FIG. 2.

An elongate thumb retainer 18 for receiving the thumb is integrally joined to shank 20. A means for receiving the fingers 22 is joined to shank 24. A hand 26 is shown in phantom outline with its thumb 28 inserted in thumb retainer 18 and fingers of the hand 30*a*, 30*b*, 30*c*, and 30*d*, inserted in means 22.

Thumb retainer 18, which is generally in line with shank 20, extends away from blade 12 at an obtuse angle. Thumb retainer 18 includes an internal cup portion, shown generally at 34, and an elongate sleeve portion, shown generally at 36, which is an extension of the cup portion. The base of the cup portion provides an abutment against which the outer end of the distal phalanx 38 of the thumb seats.

Figure 4:
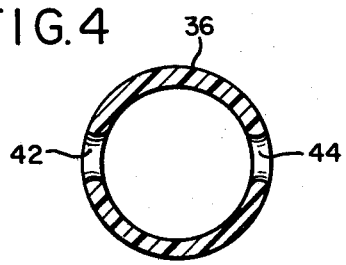
FIG. 4 is an enlarged cross-sectional view taken generally along line 4—4 in FIG. 3.

Elongate sleeve 36 which joins with the cup portion is constructed to embrace the distal and first phalanges 38, 40, respectively, of the thumb. With the thumb seated in retainer 18, the phalanges are restrained from substantial articulation therein. As can be best seen in FIG. 4, sleeve 36 is generally cylindrical so as to comfortably receive the thumb. By way of example, the sleeve may be approximately 2 inches long, and may have an internal diameter of about 1 inch.

The sleeve is provided with perforations shown at 42 and 44, to permit circulation of air into the interior of the retainer. The perforations may be elongate, ovate openings, extending parallel to the axis of the sleeve.

The longitudinal axis of sleeve 36 lies substantially within the blades' swing plane 32.

Figure 2:
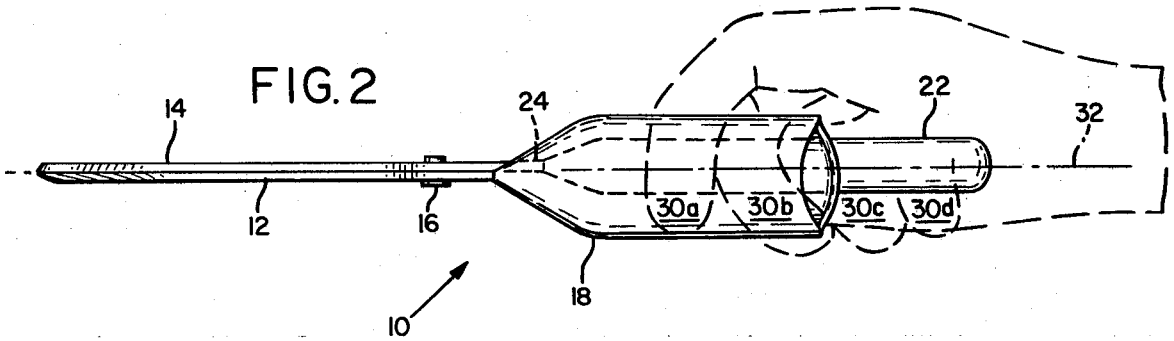
FIG. 2 is a top plan view of the scissors shown in FIG. 1.

Means for receiving the fingers 22 includes a bow portion 48 which defines an elongate opening 50. Preferably, such is long enough to receive all four fingers 30*a*, 30*b*, 30*c*, and 30*d*. As best shown in FIG. 2, means 22 is substantially in line with finger-actuated blade 14 and its associated shank 24, and lies substantially within swing plane 32. As illustrated in FIG. 1, base 34*a* of cup portion 34 is located closer to pivot means 16 than end 50*a* of opening 50 in means 22. This locates the thumb slightly forwardly of the fingers and contributes to comfort when using the scissors.

Both thumb retainer 18 and means 22 are constructed of molded plastic, of lesser density than the metal of the blades, which makes them light in weight and contributes to reduction of tendon fatigue. The surfaces delineating the retainer and finger-receiving means are rounded for comfortably receiving the thumb and the fingers.

Figure 3:
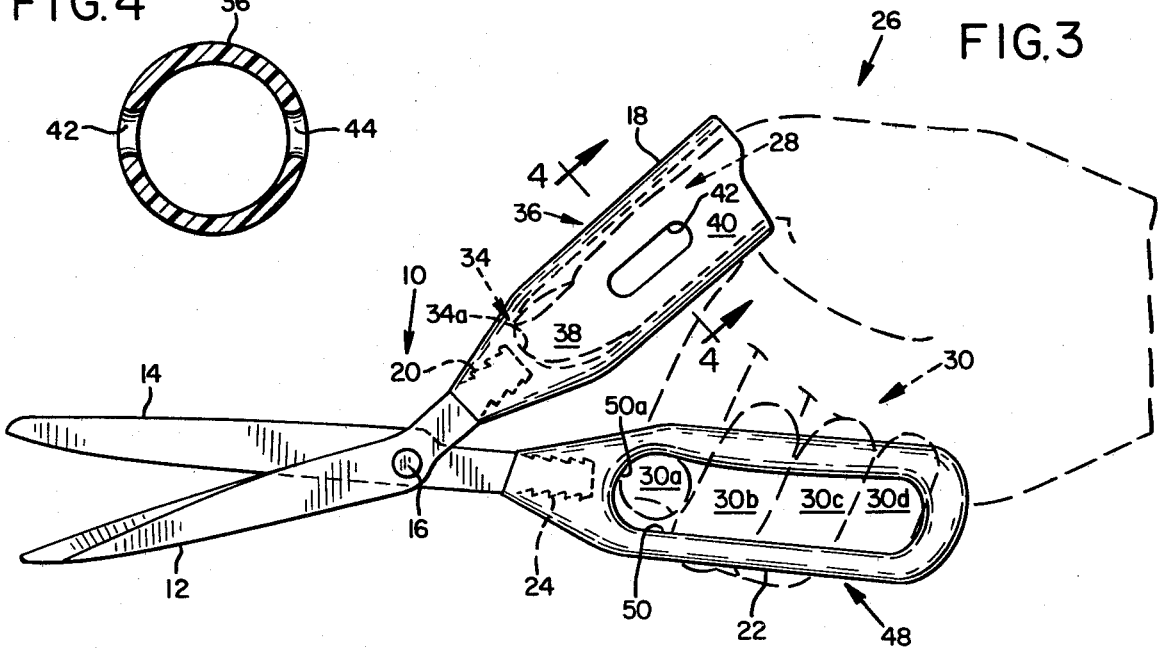
FIG. 3 is a side elevation of the scissors with the scissors opened up.

Focusing attention on FIGS. 1 and 3, with the construction described, the operator grips the scissors by placing the thumb inside thumb retainer 18 and the fingers 30*a*, 30*b*, 30*c*, and 30*d* inside opening 50 in means 22. During a cutting operation, and to open the scissors, the thumb of the operator presses against the upper interior surface of sleeve 36, thereby causing thumb-actuated blade 12 to move downwardly. At the same time, the palm of the hand expands and fingers 30*a*, 30*b*, 30*c*, and 30*d* push downwardly against the elongate lower surface of opening 50, causing finger-actuated blade 14 to move upwardly.

Typically, in cutting something such as fabric, the underside of blade 12 and the underside of means 22 rest upon a surface such as a table. So positioned, the cutting action is controlled primarily by movement of the thumb, with the longitudinal axis of the thumb lying substantially within the cutting line.

Because of the unique construction of thumb retainer 18, the thumb is held in place so that movement of the thumb is up and down in the swing plane of the blades and is generally parallel to the palm of the hand.

By limiting the upward and downward movement of the thumb to the swing plane of the blades and by keeping the thumb generally parallel to the palm of the hand, a significant reduction in tendon strain is achieved as compared to conventional scissors in which the thumb extends away from the palm at an acute angle, and the upward and downward movement of the thumb is in a path outside the swing plane of the blades and is accompanied with turning of the thumb. With the two thumb phalanges restrained from substantial articulation during actuation of the scissors, additional relief from tendon fatigue is achieved. The thumb moves more or less as a unit.

Another important feature of the invention is apparent in the lightweight and rounded construction of the thumb retainer and finger-receiving means. This is achieved by constructing the retainer and receiving means from molded plastic with rounded surfaces delineating the elements. The weight distribution that results enables the scissors to lie comfortably in the hand.

While a particular embodiment of the invention has been described, it should be obvious that variations and modifications are possible without departing from the spirit of the invention.

It is claimed and desired to be secured by letters patent:

1. In scissors, including a finger-actuated blade, a thumb-actuated blade, and pivot means pivotally interconnecting the two for relative swinging movement in a swing plane, each blade having a shank joined thereto with the blade and its associated shank extending outwardly to opposite sides of said pivot means, means for receiving the fingers joined to the shank which joins with the finger-actuated blade, and a thumb retainer for receiving the thumb integrally joined to the shank which joins with the thumb-actuated blade, the thumb retainer including a cup portion with an internal cup surface facing away from said pivot means and said internal cup surface having a base extending transversely of the shank which joins with the thumb-actuated blade, said base providing an abutment which the outer end of the distal phalanx of the human thumb seats upon thus to locate the thumb in the retainer, said retainer further including an elongate sleeve portion joining with said cup portion having an internal sleeve surface joining with said cup surface, said internal cup surface and said internal sleeve surface together forming an elongate socket which receives completely and extends on all sides about the distal phalanx of the human thumb and which has sufficient length to extend from said distal phalanx on all sides about a major portion of the length of the human thumb phalanx which joins with the distal phalanx, said socket thus being adapted to embrace the two thumb phalanges whereby such phalanges are restrained from substantial articulation with the thumb seated in the retainer, the axis of said socket lying in said swing plane.

2. The scissors of claim 1, wherein the shank joined to the finger-actuated blade is substantially aligned with the finger-actuated blade and the means for receiving the fingers comprises a bow portion defining an elongate finger-receiving opening extending generally in line with the finger-actuated blade and the shank joined thereto with one end of said opening adjacent said pivot means and the opposite end of the opening being spaced beyond said one end from said pivot means, said base of said internal cup surface being located closer to said pivot means than said one end of said opening, said socket of said thumb retainer being generally in line with the shank to which it is joined and the latter shank and the thumb-actuated blade with which it joins extending away from each other at an obtuse angle.

3. The scissors of claim 1, wherein the sleeve portion of said retainer is perforate to provide for the flow of circulating air into the interior of the retainer.

4. The scissors of claim 1, wherein the blades and shanks are metallic, and the retainer and means for receiving the fingers are of molded, lesser density plastic, and rounded surfaces delineate the thumb retainer and means for receiving the fingers.

5. In scissors, including a finger-actuated blade, a thumb-actuated blade, and pivot means pivotally interconnecting the two for relative swinging movement, a shank joined to each blade, and each shank and its associated blade extending outwardly to opposite sides of said pivot means, the blades and associated shanks being metallic, a molded plastic thumb retainer for receiving the thumb integrally joined to the shank which joins with the thumb-actuated blade, said thumb retainer including a cup portion with an iternal cup surface facing away from said pivot means and said internal cup surface having a base extending transversely of said shank which joins with the thumb-actuated blade, said base providing an abutment against which the outer end of the distal phalanx of the human thumb seats thus to locate the thumb in the retainer, said retainer further including an elongate sleeve portion joining with said cup portion having an internal sleeve surface joining with said cup surface, said internal cup surface and said internal sleeve surface together forming an elongate socket which receives completely and extends on all sides about the distal phalanx of the human thumb and has a length of at least two inches thus to extend from said distal phalanx on all sides about the human thumb phalanx which joins with the distal phalanx, said socket thus being adapted to embrace the two thumb phalanges whereby such phalanges are restrained from substantial articulation with the thumb seated in the retainer, the socket of the thumb retainer being generally in line with the shank to which the thumb retainer is joined and the latter shank and the thumb-actuated blade with which it joins extending away from each other at an obtuse angle, and the shank which joins with the finger-actuated blade connecting with the means for receiving the fingers which means is substantially in line with the finger-actuated blade.

* * * * *